United States Patent [19]

Pitelyaev et al.

[11] 4,027,441

[45] June 7, 1977

[54] ARRANGEMENT FOR ERECTING AND DISMOUNTING AN ELONGATE OBJECT HAVING ONE END ARTICULATED TO A FOUNDATION

[76] Inventors: Grigory Vasilievich Pitelyaev, Moskovskoi oblasti, shosse Entuziastov 37, kv. 49, Balashikha; Evdokim Semenovich Telpukhovsky, Sadovo-Samotechnaya ulitsa 7, kv. 75, Moscow; Boris Iosifovich Ravin, Schelkovskoe shosse 65, kv. 15, Moscow; Alexei Grigorievich Gladkov, Chongarsky bulvar 1, kor. 2, kv. 153, Moscow, all of U.S.S.R.

[22] Filed: Oct. 2, 1975

[21] Appl. No.: 619,031

[52] U.S. Cl. ..... 52/116; 173/28; 212/8 R; 254/139

[51] Int. Cl.[2] ..... E04H 12/34

[58] Field of Search ..... 52/111, 115–121; 173/28, 43; 212/8 R, 9, 13; 214/671, 75 H; 254/139, 139.1

[56] References Cited

UNITED STATES PATENTS

| | | | |
|---|---|---|---|
| 2,056,744 | 10/1936 | Smith | 52/116 |
| 2,955,431 | 10/1960 | Taylor | 52/120 X |
| 3,477,522 | 11/1969 | Templeton | 173/43 |
| 3,802,136 | 4/1974 | Eiler | 52/115 |
| 3,888,317 | 6/1975 | Walters | 52/115 X |

*Primary Examiner*—J. Karl Bell
*Attorney, Agent, or Firm*—Fleit & Jacobson

[57] ABSTRACT

An arrangement for erecting and dismounting an elongate object having one end articulated to a foundation is used, e.g. for erecting power transmission line supports into vertical or substantially vertical position. The arrangement comprises a chassis which is stationary during the installation of an object, a boom having one end thereof articulated to the chassis and a load gripping member mounted for displacement towards the distal end of the boom. In addition, the arrangement is provided, at the distal end of the boom, with an additional boom support articulated thereto which is disposed on the ground during the installation of an object. This additional boom support enables a considerable reduction of power input of means effecting the displacement of the load gripping member carrying the object due to a re-distribution of forces developed during the installation of the object.

11 Claims, 15 Drawing Figures

ARRANGEMENT FOR ERECTING AND DISMOUNTING AN ELONGATE OBJECT HAVING ONE END ARTICULATED TO A FOUNDATION

The invention relates to arrangements for erecting and dismounting elongate heavy-weight objects, such as columns or towers, power transmission line supports and supports for cableways, metal chimneys and ventilation pipes, masts for communication equipment and the like.

The invention may be used for erecting (that is installation into vertical or substantially vertical position) or dismounting (that is bringing from vertical into horizontal or inclined position) elongate objects having one end articulated to a foundation.

Known in the art are arrangements for installation into vertical or substantially vertical position of elongate heavy-weight objects.

An arrangement of that type comprises a support frame which is articulated to an object at a point above the center of gravity thereof and is connected, by means of flexible braces, to a foundation, the object having one end articulated to the foundation. Cranes having a great tilting moment are required for erecting objects into vertical position using such an arrangement.

During the lifting with a crane, the object is brought into an intermediate position in which the support frame rests against the ground to maintain the object in this position. Then the hook casing of the crane is connected to the base of the support frame, and the frame is lifted so that the object is brought from the intermediate position into vertical position.

In spite of a simple construction of this arrangement, it cannot be efficiently used in marshy and mountainous countries, because heavy-weight cranes are required which cannot practically be employed in mountainous countries where there are no large areas, whereas in marshy lands these cranes cannot be used because of a low bearing capacity of soils.

In addition, it is very difficult to move heavy-weight cranes into such lands.

Known in the art are also arrangements for installing objects into vertical or substantially vertical position of the type comprising a mast which is installed into vertical position and maintained in this position by means of bracings and anchors. During the installation of an object, several tractors are used which are connected to the object by means of ropes passing through the top of the mast.

It should be, however, noted that the installation of objects into vertical position using such masts is a very labour-consuming process which requires preparatory works for levelling the land and additional vehicles for transportation of equipment. During the erection of an object, one of the traction machines (tractor) should be re-positioned to the side opposite to the lifting direction for retaining the object during the transition over the position of unstable equilibrium. In addition, the installation of an object using a mast does not prevent damages to the object due to dynamic loads imposed by the traction machines (i.e., jerks, shocks and the like).

Known in the art are cranes comprising a boom having one end articulated to a chassis which is stationary during the installation of an object, and a load gripping member mounted for displacement towards the distal end of the boom. These cranes are, however, unsuitable for installation of an object with the vertical displacement of the load gripping member of the crane so that their employment for erecting or dismounting elongate objects having one end articulated to a foundation is associated with technical problems.

It is an object of the invention to provide an arrangement for erecting or dismounting (installing) elongate heavy objects for example, power transmission line supports of column or doubled type communication masts and other vertical structures which has a construction such as to enable installation of objects in any lands without preparatory works and without using heavy-weight high-capacity cranes.

In accordance with this and other objects, in an arrangement for erecting and dismounting an elongate object having one end articulated to a foundation, comprising a boom having one end articulated to a chassis which is stationary during the installation of an object, and a load gripping member mounted for displacement towards the distal end of the boom during the installation of an object, according to the invention, there is provided an additional boom support which is articulated to the distal end of the boom and is adapted to be placed on the ground during the installation of an object.

The provision of the boom on the chassis and the provision of the additional boom support which is placed on the ground during the installation of an object allows for erecting and dismounting an object using an arrangement having a lighter weight and a lower power input as compared to known arrangements of the type due to a re-distribution of loads developed during the installation of the object, the loads being mainly absorbed by the additional boom support.

The arrangement according to the invention eliminates the need in performing preparatory works for levelling the land, and no additional means for anchoring the arrangement in the ground are required since all necessary mechanisms are mounted to the boom, and the boom itself is mounted to the chassis.

According to the invention, the additional boom support comprises a bearing slab which is placed on the ground during the installation, and a support rod having one end articulated to the boom and the other end articulated to the slab.

With this construction of the additional boom support, an object of a moderate weight and comparatively small length (20 m and 5 tons) can be installed by displacing the load gripping member towards the distal end of the boom to cause rotation of the object about the pivotal support at the foundation.

The support rod is preferably provided with a bracket having pulleys for a rope which connects the load gripping member to a drive for effecting displacement thereof; furthermore, there is provided a braking means which is connected to the object for retaining it during the transition over the position of unstable equilibrium.

According to the invention, the additional boom support and the boom are made telescoping, and each of them is provided with means for modifying the length thereof during the installation of an object, said means comprising a rope and pulley system mounted on the rod and boom, respectively, and having an independent drive so that the extension of the rod and boom may be varied; furthermore, this enables the installation of heavy-weight (up to 20 tons) and very long (up to 45 m) objects with the same power input of the means effecting the displacement of the load gripping member because the lifting force for installation of an object increases with an increase in the length of the support rod and boom.

According to the invention, the additional boom support is made telescoping and provided with a balance beam having one end articulated to the boom and the other end articulated to the load gripping member by means of a telescoping rod, the telescoping rod of the load gripping member being provided with means for modifying the length thereof during the installation of the object, said means comprising a rope and pulley system mounted on the rod and having an independent drive so that upon every shortening of length of the additional boom support and the telescoping rod of the load gripping member, the installation of the object is effected. This permits to eliminate the need in a braking device which would be otherwise necessary for the transition of the object over the position of unstable equilibrium, because the rigid rod of the load gripping member prevents the object from falling in the direction of lifting.

With this construction of the arrangement, the boom is preferably made in the form of a telescoping rod having means for modifying the length thereof, said means comprising a rope and pulley system mounted on the rod and having an independent drive so that upon every shortening of length of the additional boom support, telescoping rods and boom, the installation of the object is effected. This permits to have a versatile arrangement, that is such an arrangement which can be used for erecting objects of any size and weight.

According to the invention, the addition boom support and the telescoping rod of the load gripping member and boom are each provided with another independent drive for bringing them into the working position during the installation of an object.

The invention is further characterized in that the additional boom support is of a gantry type, wherein vertical columns are formed by support rods and connected to a traverse by means of intermediate members which are rotatable about the traverse for varying the span between the support rods. This allows for placing the arrangement closer to the center of gravity of an object and ensures a considerable reduction of lifting force.

The traverse of the addition boom support of a gantry type is preferably articulated to two booms and two telescoping members of the load gripping member so that a stable position of the whole arrangement is ensured both during the movement of all mechanisms thereof into the working position and during the installation of an object.

The vertical columns are preferably provided with means for connecting them to one another and to the foundation so as to prevent the additional boom support from displacing relative to the object and chassis during the installation of the object.

Therefore, the arrangement for erecting and dismounting elongate heavy objects according to the invention enables a material reduction of time required for installation of objects, number of workers and traction and handling equipment as compared to known arrangements of the type and does not require any preparation of land at the working site.

The invention will now be described with reference to specific embodiments of the arrangement for erecting and dismounting elongate heavy objects illustrated in the accompanying drawings, in which.

Figure 9:
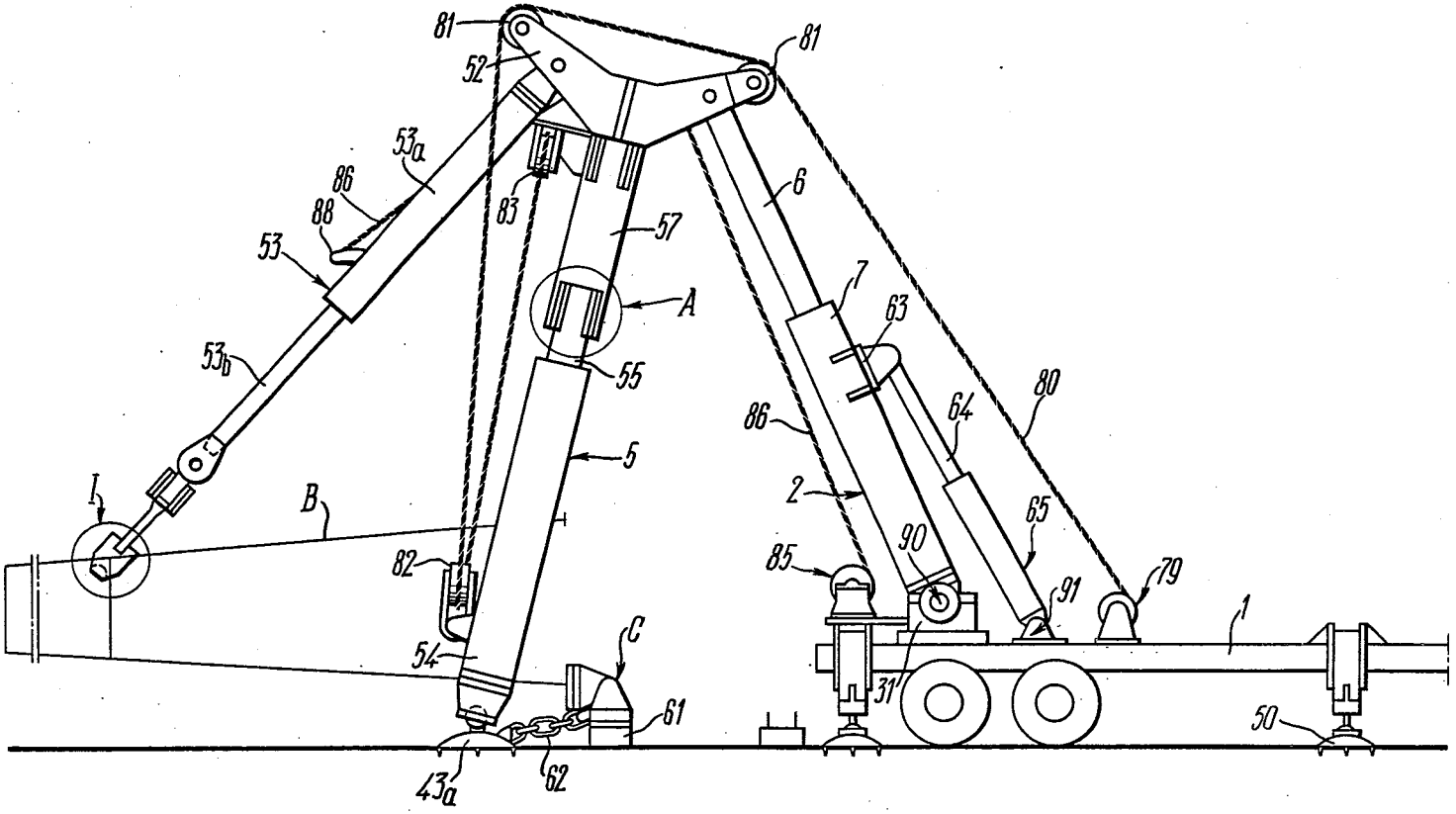
FIG. 9 is a general view of another embodiment of the arrangement according to the invention.
Figure 15:
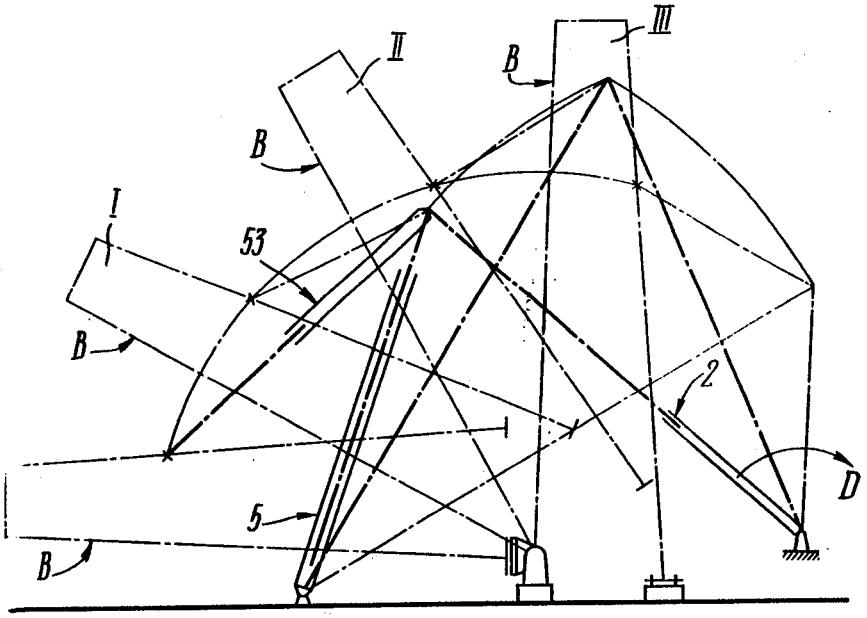

FIG. 15 diagrammatically shows the operation of the arrangement of FIG. 9.

The arrangement for erecting and dismounting (that is for installing into vertical or substantially vertical position or for bringing from vertical into horizontal position) elongate heavy objects, such as power transmission line supports comprises; a chassis 1 (FIGS. 1 and 2); a boom 2 having one end articulated to the chassis 1 for movement in the plane of installation (lifting) of objects; a load gripping member 3 mounted for displacement towards the distal end 4 of the boom 2; an additional boom support 5 articulated to the distal end 4 of the boom 2 and adapted to be placed on the ground during the installation of an object.

The arrangement may have different constructions depending on size and weight of an object to be installed.

Figure 1:
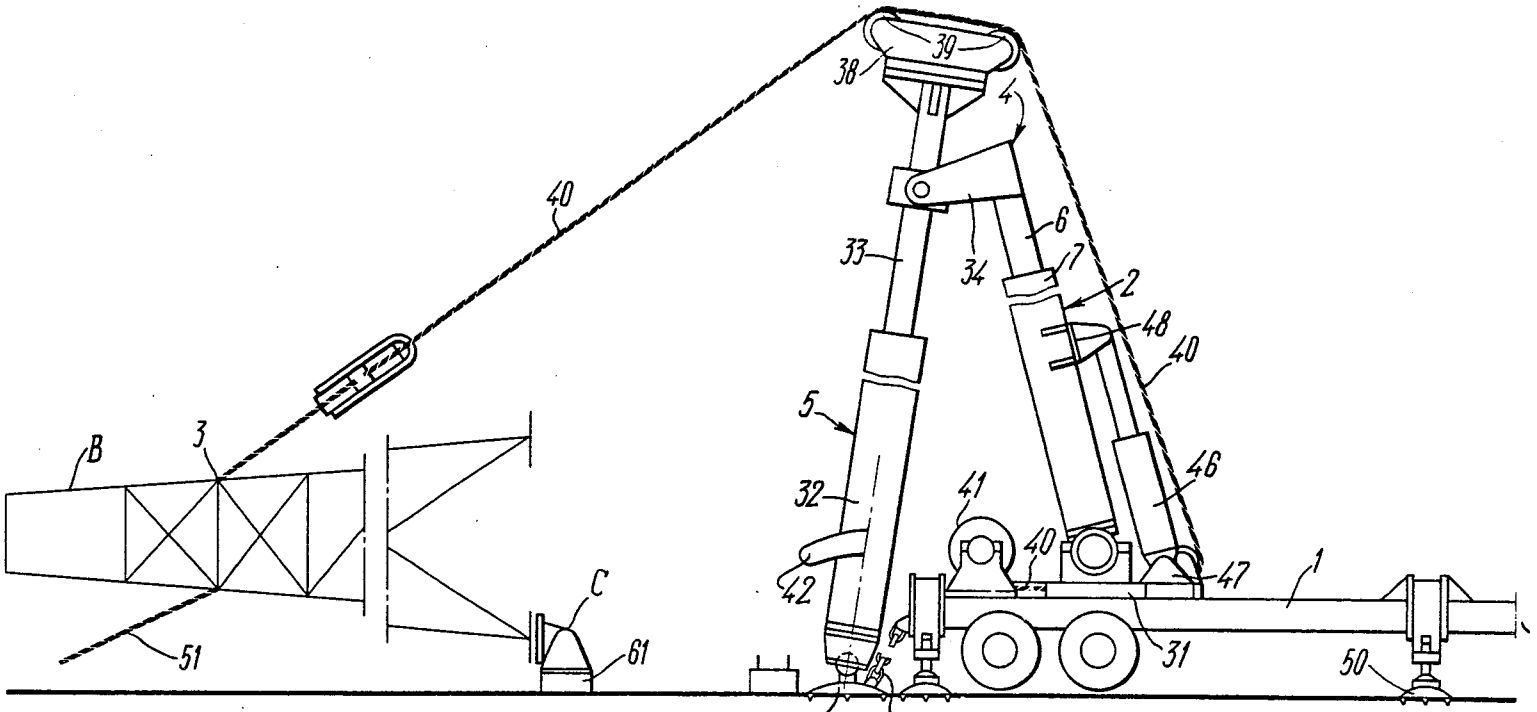
FIG. 1 is a general view of one embodiment of the arrangement according to the invention.
Figure 2:
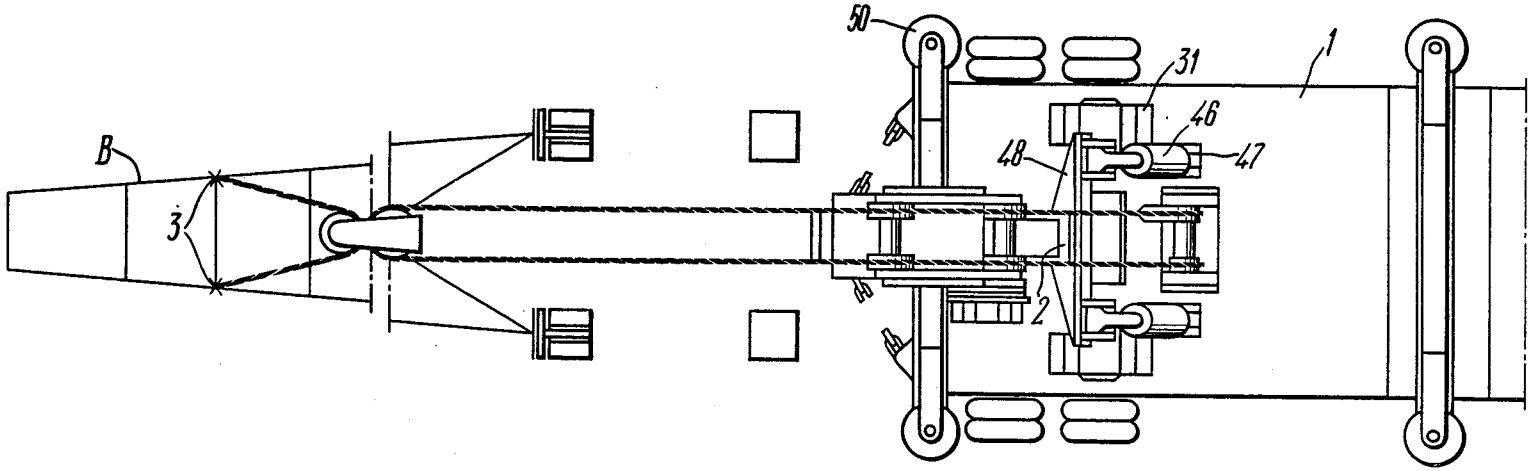
FIG. 2 is a plan view of the arrangement shown in FIG. 1.

Thus, FIG. 1 shows an arrangement in which the boom 2 and the additional boom support 5 are made telescoping. For that purpose, the boom 2 is formed by telescoping rods 6 and 7 (FIG. 3) and is provided with means for modifying the length thereof during the installation of an object. This means comprises a rope and pulley system 8 for extending the boom length and a rope and pulley system 9 for shortening the boom length.

Figure 4:
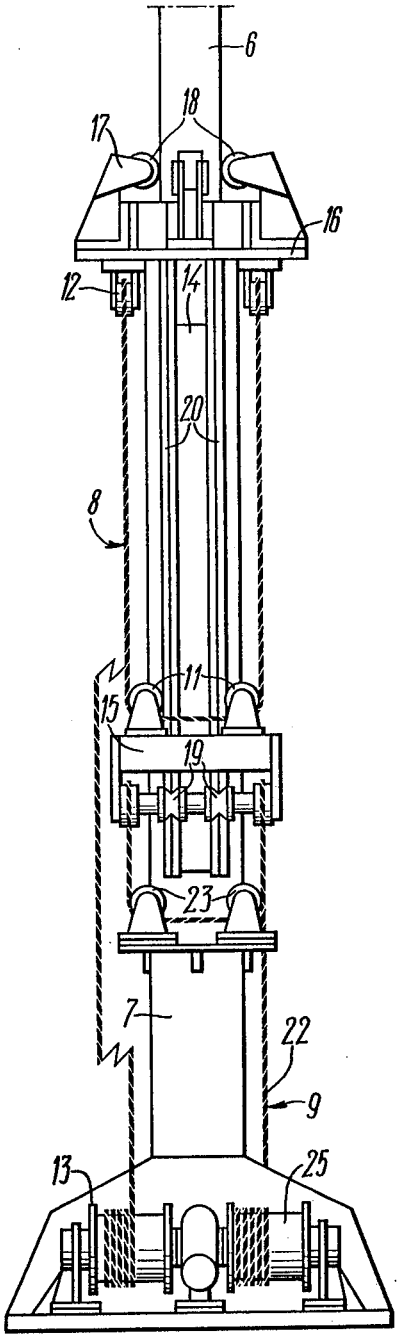
FIG. 4 shows a left side elevation of the arrangement shown in FIG. 3.

The rope and pulley system 8 comprises a rope 10, pulleys 11, 12 and a drive in the form of a winch 13 (FIG. 4). The rod 7 is made hollow and has a longitudinal through recess 14 for passage of a traverse 15 secured to the lower end of the rod 6. Casings of the pulleys 11 are fixed to the traverse 15. The upper end of the rod 7 has a flange 16 to which there are fixed casings of the pulleys 12 and brackets 17 with rollers 18.

Rollers 19 fixed to the traverse 15 move along guides 20 mounted to the rod 7 and, together with the rollers 18, form a means for aligning the rod 6 with the rod 7. One end of the rope 10 is secured to a bracket 21 (FIG. 5) of the flange 16, and the rope extends around the pulleys 12 and 11 to be secured with the other end thereof to the drum of the winch 13.

The rope and pulley system 9 comprises a rope 22, pulleys 23, 24 (FIGS. 3 and 4) and a drive in the form of a winch 25. Casings of the pulleys 23 are fixed to brackets 26 of the rod 7, and casings of the pulleys 24 are fixed to the traverse 15. The rope 22 has one end secured to a bracket 27 (FIG. 5) mounted on a flange 28 of the rod 7 and extends around the pulleys 23, 24 to be secured with the other end thereof to the drum of the winch 25 (FIG. 4).

Figure 6:
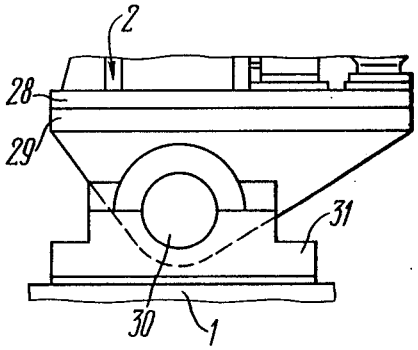
FIG. 6 is a general view showing a pivotal connection of the boom to the chassis.
Figure 7:
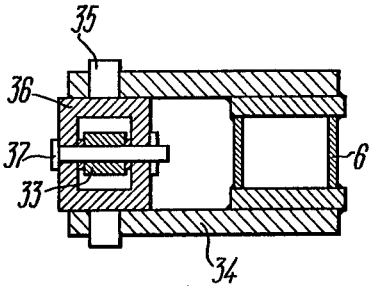
FIG. 7 is a general view showing a pivotal connection of the boom to the additional boom support.

The flange 28 (FIG. 6) of the rod 7 is rigidly connected to a flange 29 of a shaft 30 journalled with the ends thereof in bearings 31 mounted on the chassis 1, whereby the boom 2 is articulated to the chassis 1.

Figure 3:
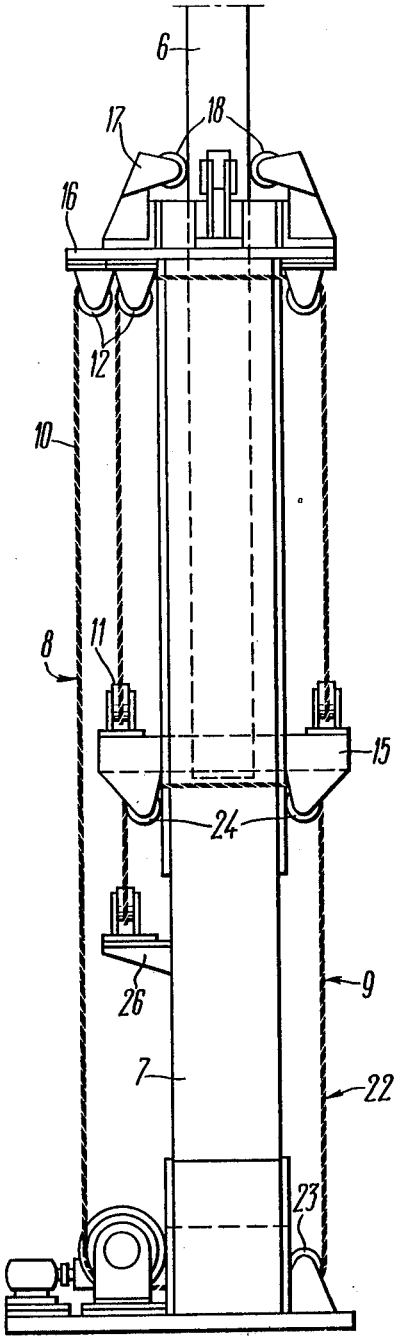
FIG. 3 is a partial general view of an embodiment with telescoping additional boom support and boom.
Figure 5:
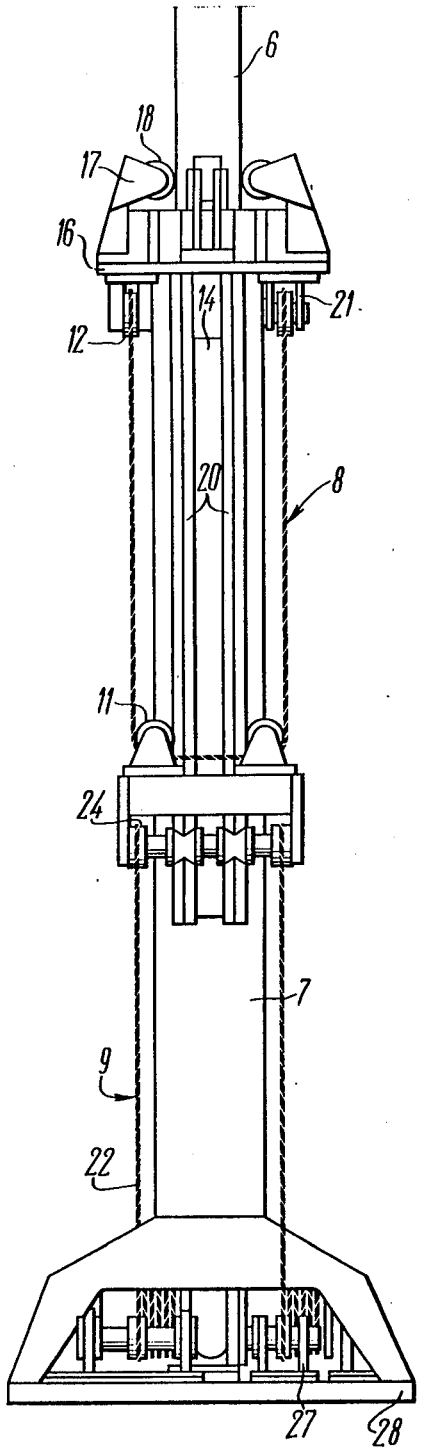
FIG. 5 shows a right side elevation of the arrangement shown in FIG. 3.

In the telescoping embodiment of the additional boom support 5 (FIG. 1), the support is formed by two telescoping rods 32, 33 and is provided with a means for modifying the length thereof during the installation of an object, said means comprising a rope and pulley system for extending the length thereof and a rope and pulley system for shortening the length thereof which are constructed similarly to the rope and pulley systems 8 and 9, respectively, shown in FIGS. 3 to 5.

The rod 33 of the additional boom support 5 (FIG. 1) is articulated to the rod 6 of the boom 2 which is provided with brackets 34. The brackets 34 are connected, by means of journals 35 and forks 36, to a pivot pin 37 mounted in the rod 33.

The upper end of the rod 33 (FIG. 1) has a bracket 38 supporting pulleys 39. A rope 40 extending around the pulleys 39 connects the load gripping member 3 to a drive thereof. The drive of the load gripping member comprises a winch 41 mounted on the chassis 1.

Figure 8:
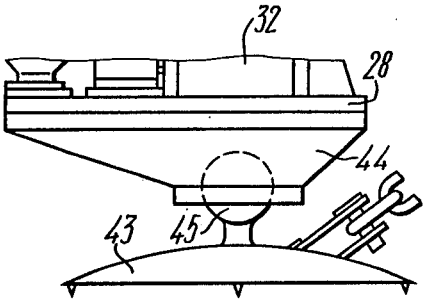
FIG. 8 is a general view showing a pivotal connection of the additional boom support to the slab.

The lower end of the rod 32 has a bracket 42 cooperating with the load gripping member 3 when the placing of the support 5 on the ground, and a bearing slab 43 articulated to the rod 32 by means of a thrust bearing 44 (FIG. 8) cooperating with a spherical surface 45 of the bearing slab 43.

It should be noted that the boom 2 and the additional boom support 5 may comprise rods of a fixed length (not shown).

For bringing the boom 2 into the working position (FIG. 1), there are provided hydraulic jacks 46 having lower ends thereof articulated to a bracket 47 mounted on the chassis 1. The piston rods of the jacks 46 are articulated to the boom 2 by means of a traverse 48.

During the installation of supports into vertical or substantially vertical position, the chassis 1 with the boom 2 and additional boom support 5 in the transport position is placed along the longitudinal axis of the object so that the object is disposed at one side of a foundation and the chassis is disposed at the opposite side of the foundation.

Then the boom 2 and the additional boom support 5 are brought, by means of the hydraulic jack 46, from the transport position into the working position shown in FIG. 1, the additional boom support being suspended to the boom 2. After that, the load gripping member 3 is connected to the bracket 42, and the rope 40 is wound on the drum of the winch 41 to rotate the additional boom support 5 into an inclined position relative to the boom 2. In order to place the additional boom support on the ground, the boom 2 is additionally rotated by the jack 46 in the direction towards the object in case of the additional boom support comprising a unitary rod, or the length of the additional boom support 5 is extended when the latter is made telescoping.

Subsequently, the bearing slab 43 is connected to the chassis 1 by means of flexible braces 49, such as chains. It should be noted that, prior to the bringing of the boom 2 into the working position, the chassis 1 is mounted, by means of outriggers 50 of any appropriate type, in such a manner that the plane of the chassis should be in horizontal position.

Then the load gripping member 3 is connected to an object B which is, in turn, connected to any known braking means 51 (the braking means may comprise tractors, winches and the like). The drive of the winch 41 is energized, and the rope 40 is wound on the drum thereof so that the object is caused to rotate about a pivot C of the foundation to be erected into vertical position, the braking means 51 preventing the object B from falling during the transition over the position of unstable equilibrium.

Lifting forces may be reduced by extending the additional boom support 5 and boom 2 by making them telescoping.

The extension of length of the additional boom support 5 or boom 2 is effected by winding the rope 10 on the drum of the winch 13 while winding the rope 22 from the drum of the winch 25, whereby the rod 33 or the rod 6 is extended from the rod 7 or the rod 32, respectively. For shortening the length of the additional boom support 5 and boom 2 required when dismounting the object or for returning them back into the transport position, the rope 22 is wound on the drum 25, and the rope 10 is unwound from the drum 13, whereby the rod 33 or the rod 6 is retracted into the rod 7 or the rod 32, respectively.

In accordance with another embodiment of the arrangement, the additional boom support 5 (FIG. 9) is made telescoping similarly to the embodiment shown in FIGS. 1, 3 to 5, and is provided, at the upper end thereof, with a balance beam 52 having one end articulated to the boom 2 and the other end articulated, by means of a telescoping rod 53, to the laod gripping member 3.

The telescoping rod 53 is constructed similarly to the additional boom support 5 shown in FIGS. 1, 3 to 5. It should be noted that, similarly to the additional boom support 5, the rod 53 has a means for modifying its length during the installation of an object, said means comprising rope and pulley systems which are identical to the rope and pulley systems 8 and 9 and have independent drives.

The boom 2 articulated to the balance beam 52 may be of fixed length or it may be telescoping. When the boom 2 is made telescoping, it is constructed similarly to the boom shown in FIGS. 3, 4, 5, that is the boom has a means for modifying its length comprising a rope and pulley system mounted on the boom and having an independent drive.

Where the boom is of a fixed length, the object B is installed by alternately shortening first the length of the telescoping rod 53 and then the length of the additional boom support 5.

Figure 10:
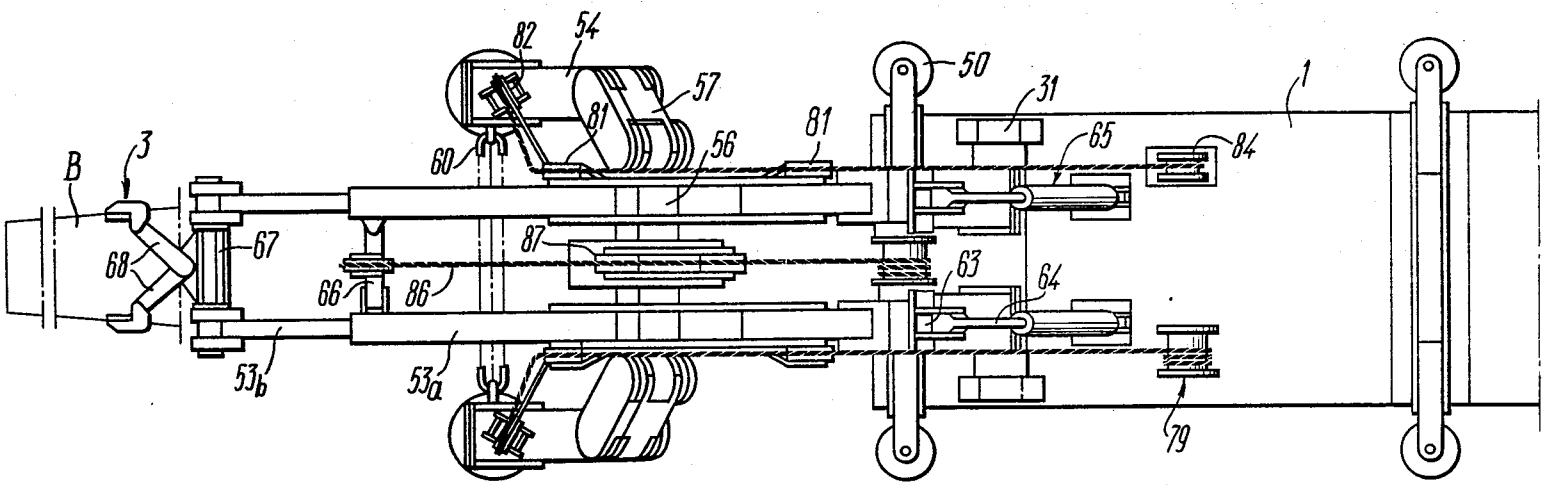
FIG. 10 is a plan view of the arrangement shown in FIG. 9.
Figure 11:
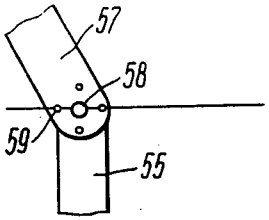
FIG. 11 shows a detail A in FIG. 9.

The additional boom support 5 (FIGS. 9 and 10) is of a gantry type with telescoping vertical columns each formed by telescoping rods 54 and 55 inserted into one another similarly to the rods 32 and 33 (FIGS. 1, 3 to 5), and a traverse 56 (FIG. 10). The traverse 56 is connected to the vertical columns by means of intermediate members 57. It should be noted that each member 57 is connected to the rod 55 and traverse 56 by means of an axle 58 (FIG. 11) fixed by bolts 59 so as to adjust the intermediate members 57 by rotating them relative to the traverse or vertical columns to vary the span between the vertical columns. It should be also noted that the bearing slabs 43*a* (FIG. 9) of the vertical columns are connected both to one another by means of flexible braces, such as chains 60 (FIG. 10) and to the foundation 61 by means of a chain 62 (FIG. 9) during the installation of an object.

In accordance with further embodiment of the invention, two booms 2 and two telescoping rods 53 of the load gripping member 3 are connected to the traverse 56 (FIG. 10) and to the additional boom support 5, both booms 2 being interconnected by means of a traverse 63 which is articulated to piston rods 64 of hydraulic jacks 65 effecting the displacement of the boom 2 into the working or transport position, together with the additional boom support 5 and telescoping rods 53.

The upper parts 53*a* of the rods 53 are interconnected by means of a traverse 66, and the lower parts 53*b* of the rods 53 are articulated to each other by a traverse 67 supporting the load gripping member 3. The load gripping member 3 comprises two articulated members 68 each including a hook 69 (FIG. 12) and a screw 70 with a hook-shaped head 71.

Figure 13:
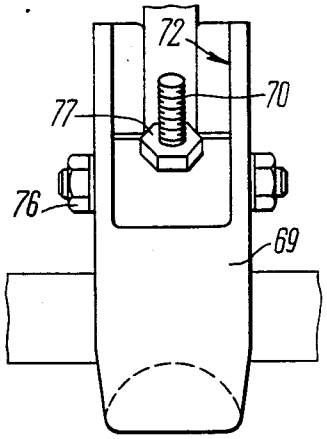
FIG. 13 shows a right side elevation of the arrangement shown in FIG. 12.
Figure 12:
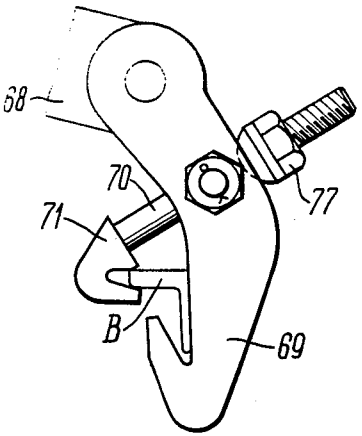
FIG. 12 is a general view of a load gripping member.
Figure 14:
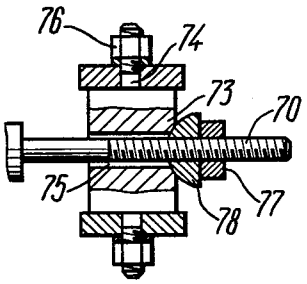
FIG. 14 is a plan view partially in section of the arrangement shown in FIG. 12.

The body of the hook 69 is made with a slot 72 (FIG. 13) accommodating a shaft 73 (FIG. 14) having journals 74 at the ends thereof and a central hole 75. The shaft 73 is retained on the hook 69 by nuts 76. The screw 70 (FIG. 14) extends through the hole 75, and a nut 77 with a spherical washer 78 is mounted at the end of the screw for aligning the screw in the hole 75, the screw 70 being retained in the hole 75 by the hook-shaped head 71 thereof, on the one hand, and by the nut 77, on the other hand, (FIG. 12).

For moving the additional boom support 5 into the working or transport position, there is provided an additional drive. Thus, for moving the additional boom support, a winch 79 (FIG. 9) is used having a rope 80 passing around pulleys 81 fixed to the balance beam 52, pulleys 82 mounted on the rod 54 and pulleys 83 mounted on the traverse 56, one end of the rope being secured to the drum of the winch 79 and the other end being secured to a bracket 84 (FIG. 10) mounted on the chassis 1.

For moving the telescoping rod 53 into the working position, there is provided an additional drive comprising a winch 85 (FIG. 9) having a rope 86 secured to the drum thereof. The rope 86 extends around pulleys 87 (FIG. 10) mounted on the traverse 56 and has the other end thereof secured to a bracket 88 (FIG. 9) fixed to the traverse 66.

The arrangement, wherein the boom 2, additional boom support 5 and rod 53 are made telescoping, operates in the following manner.

The chassis 1 is placed along the longitudinal axis of an object so that the object is disposed at one side of a foundation 61 and the chassis 1 is disposed at the other side of the foundation. Then, depending on the width of the object being erected, the span of the additional boom support 5 of the gantry type is adjusted if necessary. For that purpose, the bolts 59 (FIG. 11) of the pivotal joint between the member 57 and the traverse 56 and vertical columns are removed, and the members 57 are rotated at a desired angle by shortening the length of the rope 80 (FIG. 9) by the winch 79. Then the adjusted position of the members 57 is fixed by the bolts 59. After that, the chassis 1 is placed in the horizontal position by using outriggers 50. Then the hydraulic jacks 65 are actuated, and their piston rods 64 bring the boom 2 and the additional boom support 5 and telescoping rod 53 into the working position in which the ropes 80 and 86 are unwound from the drums of the winches 79 and 85, respectively. Subsequently, the additional boom support 5 is placed on the ground, and the bearing slab 43*a* thereof is connected to the foundation by means of the chain 62, the vertical columns of the additional boom support 5 being interconnected by means of the chain 60 (FIG. 10).

Then the telescoping rod 53 is extended at a desired amount by shortening the length of the rope and pulley system similar to the rope and pulley system 8 shown in FIGS. 3 to 5, whereafter the telescoping rod 53 is positioned, by means of the rope 86 and winch 85 (FIG. 9), in such a manner that the load gripping member 3 thereof grips the frame of the object B as shown in FIG. 12.

As a result of the above-described operations, the boom 2, the additional boom support 5 and the telescoping rod 53 take the position shown in FIGS. 9 and 15, the boom 2 and the rod 53 being extended, and the additional boom support 5 being retracted.

The installation of the object will now be described, the retraction or extension of the telescoping rod 53, additional boom support 5 and boom 2 being effected as described for the rope and pulley systems 8, 9 with reference to FIGS. 3 to 5. By shortening the length of the rod 53, the object B is brought into an intermediate position indicated at I in FIG. 15 and then, by extending the additional boom support 5, the object is brought into another intermediate position indicated at II. Then the boom 2 is retracted, and the object is brought from the position II into a position III, that is into vertical position, and, during the transition over the position of unstable equilibrium, the object is prevented from falling in the lifting direction by the rod 53 and boom 2. It should be noted that during the above-described installation the boom 2 is rotated about its pivotal joint 90 at the chassis 1 in the direction indicated by arrow D, and the piston rod 64 (FIG. 9) is retracted into the hydraulic jack 65 concurrently with the rotation of the hydraulic jack about its pivotal joint 91 at the chassis 1.

After the installation of the object, the load gripping member 3 is disconnected from the object B, the chains 62 are disconnected from the foundation 61, the chain 60 is disconnected from one of the vertical columns of the additional boom support 5, and after that, the length of the additional boom support 5 is shortened, and the hydraulic jack 65 is actuated to bring the boom 2 and the additional boom support 5 and telescoping rod 53 into the transport position.

Then the outriggers 50 are placed on the chassis which may be transported to the place of installation of a next object.

What is claimed is:

1. An arrangement for erecting and dismounting an elongated heavy object having one end articulated to a foundation, comprising: a chassis which is stationary during the reaction or dismounting of an object; a boom having two ends, one end being a distal end and the other end being articulated to said chassis; a load gripping member mounted for displacement towards the distal end of said boom during the installation of an object; an additional boom support for supporting said boom, said additional boom support being articulated to the distal end of the boom and being placed on the ground during the installation of an object; means for effecting said displacement of the load gripping member.

2. An arrangement according to claim 1, wherein said additional boom support comprises a slab which is placed on the ground during the installation of an object and a support rod having one end articulated to the boom and the other end articulated to the slab.

3. An arrangement according to claim 2, wherein the support rod has a bracket supporting pulleys for a rope connecting the load gripping member to a drive effecting the displacement of the load gripping member, there being provided a braking means connected to the object to retain it during the transition over the position of unstable equilibrium upon shortening of the rope.

4. An arrangement according to claim 1, wherein the additional boom support and the boom are made telescoping, and each of them is provided with means for modifying the length thereof during the installation of an object, said means comprising a rope and pulley system mounted on the additional boom support and on the boom, respectively and provided with an independent drive so as to modify the length of the additional boom support and boom.

5. An arrangement according to claim 1, wherein the additional boom support is made telescoping and is provided with a balance beam having one arm articulated to the boom and the other arm articulated to the load gripping member by means of a telescoping rod, the telescoping rod of the load gripping member having means for modifying its length during the installation of an object, said means comprising a rope and pulley system mounted on the rod and having an independent drive, whereby, the object is installed by alternately shortening the length of the additional boom support and of the telescoping rod of the load gripping member.

6. An arrangement according to claim 5, wherein the boom is made telescoping and has means for modifying its length, said means comprising a rope and pulley system mounted on the rod and having an independent drive, whereby the installation of an object is effected by alternately shortening the length of the additional boom support, rods of the load gripping member and the boom.

7. An arrangement according to claim 6, wherein the additional boom support and the telescoping rods of the load gripping member and boom are each provided with still another independent drive for bringing them into the working position for installation of an object.

8. An arrangement according to claim 1, wherein the additional boom support is of a gantry type, wherein vertical columns comprised support rods and are connected to a traverse by means of intermediate members which are rotatable about the traverse for varying the span between the support rods.

9. An arrangement according to claim 8, wherein there are provided two booms and two telescoping rods of the load gripping member which are articulated to the traverse of the additional boom support of a gantry type.

10. An arrangement according to claim 9, wherein the vertical columns are provided with means for interconnecting them during the installation of an object.

11. An arrangement according to claim 9, wherein the additional boom support is provided with means for connecting it to a foundation.

* * * * *